US006388237B1

(12) United States Patent
Miyahara et al.

(10) Patent No.: US 6,388,237 B1
(45) **Date of Patent: *May 14, 2002**

(54) HEATER CABLE IN COMBINATION WITH A LEAD CABLE

(75) Inventors: Shouhei Miyahara; Hidekazu Aoki; Kazuhiko Koiwai; Atsushi Nakajima, all of Nagano; Toshikazu Nishiwaki, Mie; Yutaka Mizumura, Shiga, all of (JP)

(73) Assignees: Totoku Electric Co., Ltd., Tokyo; Toyo Boseki Kabushiki Kaisha, Osaka, both of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/377,602

(22) Filed: Aug. 19, 1999

(51) Int. Cl.[7] ..... H05B 3/44

(52) U.S. Cl. ..... 219/544; 219/546; 219/549; 219/553

(58) Field of Search ..... 219/549, 270, 219/535, 536, 538, 542, 544, 546, 553; 174/36, 113 R

(56) References Cited

FOREIGN PATENT DOCUMENTS

| | | |
|---|---|---|
| JP | 9260040 | 10/1997 |
| JP | 2961590 | * 10/1999 |
| JP | 11354262 | 12/1999 |

* cited by examiner

*Primary Examiner*—Tu Ba Hoang
(74) *Attorney, Agent, or Firm*—Jordan and Hamburg LLP

(57) ABSTRACT

A heater cable is wired in combination with a lead cable, the two cables form a pattern wherein the heater cable and the lead cable are spaced by a predetermined distance L, in the range of 0 to 10 mm, from each other and are supplied with opposite flow of current. The heater cable has a core thread, a heating element wire wound in a spiral on the outer surface of the core thread, a fusing layer provided over the heating element wire, a signal wire wound in a spiral on the outer surface of the fusing layer and a protective coating provided over the signal wire. The lead cable has a conductive wire covered at its outer surface with an insulating coating.

5 Claims, 11 Drawing Sheets a DCS curve of copolymer polyester resin (A)

a DCS curve of copolymer polyester resin (B)

a DCS chart of nylon-12 a TMA curve of the copolymer polyester resin (A)

a TMA curve of the copolymer polyester resin (B)

a TMA chart of the nylon-12

Prior Art

HEATER CABLE IN COMBINATION WITH A LEAD CABLE

BACKGROUND OF THE INVENTION

1. Field of the Invention

The present invention relates to a heater cable in combination with a lead cable. More particularly, the invention relates to a wiring pattern which is capable of minimizing the generation of leak magnetic field from the heater cable.

2. Description of the Prior Art

A conventional sheet-like heating appliance such as an electric blanket or an electric carpet is fabricated by wiring a heater cable 40 and a sensor cable 50 in a combination in a carpet fabric material; for example, the heater cable 40 comprising, as shown in FIG. 15, a heating element wire 32 wound in a spiral at intervals of a given distance on the outer surface of a polyester core thread 31, a fusing layer 33 of nylon or polyester provided over the heating element wire 32, a short-circuit wire 34 wound in a spiral on the outer surface of the fusing layer 33, and a protective coating 35 of polyvinyl chloride (PVC) provided over the short-circuit wire 34, and the sensor cable 50 comprising, as shown in FIG. 16, a signal wire 42 wound in a spiral on the outer surface of a polyester core thread 41, a fusing layer 43 provided over the signal wire 42, another signal wire 44 wound in a spiral on the outer surface of the fusing layer 43, and a protective coating 45 provided over the signal wire 44.

In such a conventional sheet-like heating appliance when turned on, the heating element wire 32 of the heater cable 40 only is supplied with a flow of current.

The fusing layer 33 and 43 have a so-called fusing function (fuse action) that when the heater cable 40 is overheated with a sensor wire 50 on the sheet-like heating body malfunctioning and its temperature locally rises up close to the melting point of a resin material of the fusing layer 33 and 43 (referred to as a fusing layer material hereinafter), the fusing layer material is softened or fused to short-circuit between the heating element wire 32 and the short-circuit wire 34, and the signal wires 42 and 44, and to disconnect the power supply. More particularly, the fusing layer 33 and 43 are designed to act as finally a safety circuit for protecting the sheet-like heating body from being overheated.

The polyamide resin, such as nylon-12, which is used in the fusing layer 33 and 43 have acceptable levels of molding formability, mechanical properties, and thermal properties required for the fusing layer material.

When the heater cable 40 of the conventional appliance arranged in a known pattern is energized, the current which flows in the heater cable 40 may generate a leak magnetic field. Consequently, high frequencies of the leak magnetic field develop a magnetic noise which gives adverse effects over the other electric appliances. It is now said that low frequencies may also affect the human body. Therefore, those problems are particularly emphasized in the conventional sheet-like heating appliances, namely electric blankets and carpets, for warming the human body.

SUMMARY OF THE INVENTION

The present invention has been schemed for solving the above problems of the prior art and its object is to provide a wiring pattern which is capable of diminishing the leak magnetic field from the heater cable, as preferably applicable to a sheet-like heating appliance such an electric blanket or an electric carpet.

As a first feature of the present invention, a heater cable in combination with a lead cable, in which the heater cable comprising a heating element wire wound in a spiral on the outer surface of a core thread, a fusing layer coated over the heating element wire, a signal wire wound in a spiral on the outer surface of the fusing layer and a protective coating provided over the signal wire, the lead cable comprising a conductive wire covered at its outer surface with an insulating coating, and the heater cable and the lead cable are formed such a pattern that the heater cable and the lead cable are spaced by a predetermined distance L from each other and are capable to be supplied with opposite flows of current is provided.

In the heater cable in combination with the lead cable according to the first feature of the present invention, the two opposite flows of current introduced into the heater cable 10 and the lead cable 20 respectively permit their induced intensities of magnetic field to be offset by each other, hence diminishing the leak magnetic field.

As a second feature of the present invention is a heater cable in combination with a lead cable, wherein the distance L is not greater than 10 mm.

In the heater cable in combination with the lead cable according to the second feature of the present invention, the distance L between the heater cable 10 and the lead cable 20 which are uniformly spaced from each other in the wiring pattern is set not greater than 10 mm, thus effectively diminishing the leak magnetic field. It is desired that the above mentioned fusing layer comprises copolymer polyester resin which has the following characteristics (a) and/or (b) and (c) to (f).

(a) The angle $\alpha$ between the baseline and a tangent to the heat absorption peak of a Differential Scanning Colorimetry (DSC) curve defined by a Japanese Industrial Standard (JIS) K7121 (ISO 3146) method is 90° to 120°.

(b) The angle $\alpha'$ between the baseline and a tangent to the shift portion of a ThermoMechanical Analysis (TMA) curve determined in an expansion mode by a thermal-mechanical measuring method is 90° to 100°.

(c) The melting point is 160° C. to 210° C.

(d) The reduction viscosity is not lower than 0.5 dl/g.

(e) The moisture absorption is not higher than 1.0% at a temperature of 20° C. and a relative moisture rate of 65%.

(f) The hardness measured by a JIS K7215 (ISO 868) method is Hardness Degree (HDD) 40 to 74.

Also, it is desired that the anti-heat deterioration of the resin of the fusing layer stand for 500 hours at a temperature of 140° C.

The composition of the above mentioned copolymer polyester resin is now explained in more detail. One of its acid components is aromatic dicarboxylic acid which may be selected from terephthalic acid, isophthalic acid, 2-6-naphthalenedicaboxylic acid, biphenyldicarboxylic acid, so on and their ester. Similarly, its aliphatic dicarboxylic acid component having 2 to 20 carbon atoms may be selected from succinic acid, glutaric acid, adipic acid, azelaic acid, sebacic acid, dodecanedionic acid, dimer acid, so on and their ester. Its alicyclic dicarboxylic acid component may be selected from 1.4-cyclohexanedicarboxylic acid, so on and its ester. Its hydroxy-carboxylic acid component may be selected form p-hydroxy-aromatic acid, so on and its ester.

Its glycol component is aliphatic glycol which may be selected from 1,4-butanediol, 1,3-butanediol, 1,2-butanediol, ethylene glycol, propylene glycol, 1,2-propanediol, 1,3-propanediol, 1,5-pentadiol, 3-metyl-1,5-pentadiol, 1,9-nonanediol, 1,6-hexanediol, doracanedionic acid, neopentyl glycol, neopentyl glycol hydroxy pivalate, 2-ethyl-2-butylpropanediol, and bisphenol-A-ethylene-oxide or -propylene-oxide derivative, so on.

Other copolymer components than the above mentioned are glycol such as polyethylene glycol, polypropylene glycol, polytetramethylene glycol, so on, ϵ-caprolactone, hyroxycapronic acid, polycaprolactone, and tricyclodecanedimethylol, so on.

The above materials may arbitrarily be combined in a desired combination or ratio without departing from the characteristics (a) to (f) defined above to produce a type of the copolymer polyester resin according to the present invention. The copolymer polyester resin of the present invention may be added, if desired, with anti-oxidation agents, stabilizers, anti-copper agents, non-organic fillers, nucleating agents, surface activators, anti-static agents, flame-retardants, plasticizers, and thickening agents, so on.

Thermoplastic resins are generally classified into crystalline polymer and non-crystalline polymer depending on their molecular structures. Such polymers have a wide range of melting points in a given temperature range based on the motion of a main chain of the polymers and show no sharp phase shift compared with non-organic compounds and metallic substances, thus determining no definite melting points. This allows the resin material of the fusing layer in a heater cable to commonly employ polyamide resins (nylon-11 and nylon-12) which have comparatively definite melting points. Polyamide resins are however less favorable in the moisture absorption than the other resins. We, the inventors, had been engaged to focus on copolymer polyester resins to develop a novel material which is not related to the disadvantages of polyamide resins. After closely examining the resin composition and the behavior of softening and melting, we invented a novel copolymer polyester resin featuring particular relationship between the DSC and TMA characteristics and the fusing characteristic essential for a heater cable. The action of the characteristics (a) to (f) of the present invention will now be described in detail.

Having the characteristic (a) that the angle α between the baseline and a tangent to the heat absorption peak of a DSC curve is 90° to 120° (preferably, 90° to 110° ), the fusing layer provides a sharp thermal fusing function. However, when the angle a exceeds 120°, a range of the softening fluidity of the resin will be increased hence declining the thermal fusing function.

Having the characteristic (b) that the angle α' between the baseline and a tangent to the shift portion of a TMA curve is 90° to 100° (preferably, 90° to 95°), the fusing layer provides as a sharp thermal fusing function as of the characteristic (a). However, when the angle α' exceeds 100°, a range of the softening fluidity of the resin will be increased hence declining the thermal fusing function. This may cause actual measurements of the fusing temperature to vary more or less.

Also, as the thermal behavior is governed by the characteristics (a) and (b), the melting point is practically limited to a definite range (160 to 210° C.). This allows the fusing temperature to be arbitrarily changed within the range. Accordingly, the selection of the fusing temperature can be made from a wider range than that of polyamide resin, hence permitting the fabrication of more practically useful heater cable.

As specified by the character (c), the copolymer polyester resin has a melting point ranging from 160° C. to 210° C. (preferably, from 170° C. to 200° C.) and can thus be used favorably as the material of the fusing layer. If the melting point is set to lower than 160° C, the heater cable may often be heated close to 160° C. locally depending on its using condition and the temperature will rise easily to its limit level of overheat protection determined by the design criterion. This discourages the reliability of the heater cable as the commercial product. When the melting point is set to higher than 210° C., the fusing temperature of the fusing layer becomes too high, i.e. the surface temperature of the product is too high, and will hardly satisfy applicable safe standards.

As specified by the characteristic (d), the copolymer polyester resin has a reduction viscosity of not lower than 0.5dl/g (preferably, not lower than 0.7dl/g) and can favorably be used as the material of the fusing layer. If the reduction viscosity is set to lower than 0. 5dl/g, the delivery of the resin during the tubing extrusion will be unstable thus failing to form a uniform thickness of the fusing layer. This causes the heater cable to have poor mechanical properties, for example, less in the strength and the extensibility, thus shortening the operating life.

As specified by the characteristic (e), the copolymer polyester resin has a moisture absorption of not higher than 1.0% (preferably, not higher than 0.8%) at a temperature of 20° C. and a relative moisture rate of 65% and can favorably be used as the material of the fusing layer. If the moisture absorption exceeds 1.0%, the resin may easily be affected by an ambient condition (moisture).

The moisture absorption of nylon-11 and nylon-12 which are commonly used is substantially 1.3% (cited from "Chemical Fiber II", p. 406, by Hiroshi Matsuzaki and Kenji Oshina, Maruzen Publishing in Japan) at a temperature of 20° C. and a relative moisture rate of 65%, which is much higher than 1.0%. In fact, such nylon-11 and nylon-12 are still employed with their disadvantage on the moisture absorption being compensated since no appropriate materials for the fusing layer are so far provided which can replace the nylon-11 and nylon-12.

A polyester resin comprising terephthalic acid and ethylene glycol is known which has a small level of water (moisture) absorption and is good in electric characteristics. This resin is favorable in mass production and overwhelmingly accepted as one of the most common-use resins. This is now used as a cable core for a heating conductor in a heater cable but not as the material as the fusing layer. One of the reasons is that the melting point of the resin is as high as 256 to 265° C. (cited from "Synthetic Polymer V" by Shunsuke Murahashi) and not favorable for use as a thermal fuse in view of the safety requirements.

As specified by the characteristic (f), the copolymer polyester resin has a hardness of HDD 40 to 74 (preferably, HDD 50 to 70) and can favorably used as the material of the fusing layer. If the hardness is smaller than HDD 40, the fusing layer will be too soft when extrusion processed. This causes the short-circuit signal line to be sunk down into the fusing layer when wound over, whereby the fusing temperature will vary more or less. If the hardness exceeds HDD 74, the fusing layer will be too hard when extrusion processed. This causes the heater cable to be declined in the flexibility, hence making wiring works difficult in the production of electric blankets or carpets.

DETAILED DESCRIPTION OF THE PREFERRED EMBODIMENTS

The present invention will be described in more details in the form of preferred embodiments illustrated in the accompanying drawings. It is understood that the present invention is not limited to the illustrated embodiments.

1. First Embodiment

Figure 1:
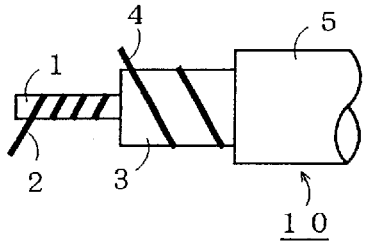
FIG. 1 is a schematic view showing a structure of a heater cable employed in a wiring pattern according to the present invention.

FIG. 1 is a schematic view showing a structure of a heater cable employed in the wiring pattern of the present invention.

As shown in FIG. 1, the heater cable 10 has a structure comprising a core thread 1, a heating element wire 2 wound in a spiral at intervals of a given distance on the outer surface of the core thread 1, a fusing layer 3 provided over the heating element wire 2, a signal wire 4 wound in a spiral on the outer surface of the fusing layer 3, and a protective coating 5 provided over the signal wire 4.

The core thread 1 may be polyester fabric. The heating element wire 2 may be flat square copper, flat square copper alloy, round copper, or round copper alloy wire. The fusing layer 3 may be made of nylon or polyester. The signal wire 4 may be flat square copper, flat square copper alloy, round copper, or round copper alloy wire. The protective coating 5 may be made of PVC.

Figure 2:
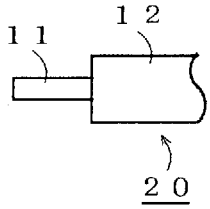
FIG. 2 is a schematic view showing a structure of a lead cable employed in the wiring pattern according to the present invention.

FIG. 2 is a schematic view showing a structure of a lead cable employed in the wiring pattern of the present invention.

As shown in FIG. 2, the lead cable 20 has a structure comprising a conductive wire 11 coated at its outer surface with an insulating coating 12. The conductive wire 11 may be selected from a single wire of copper, copper alloy, or their plated, a strand of copper, copper alloy, or their plated wires, and a twisted cable of copper, copper alloy, or their plated wires twisted at proper pitches. The insulating coating 12 may be made of PVC.

Figure 3:
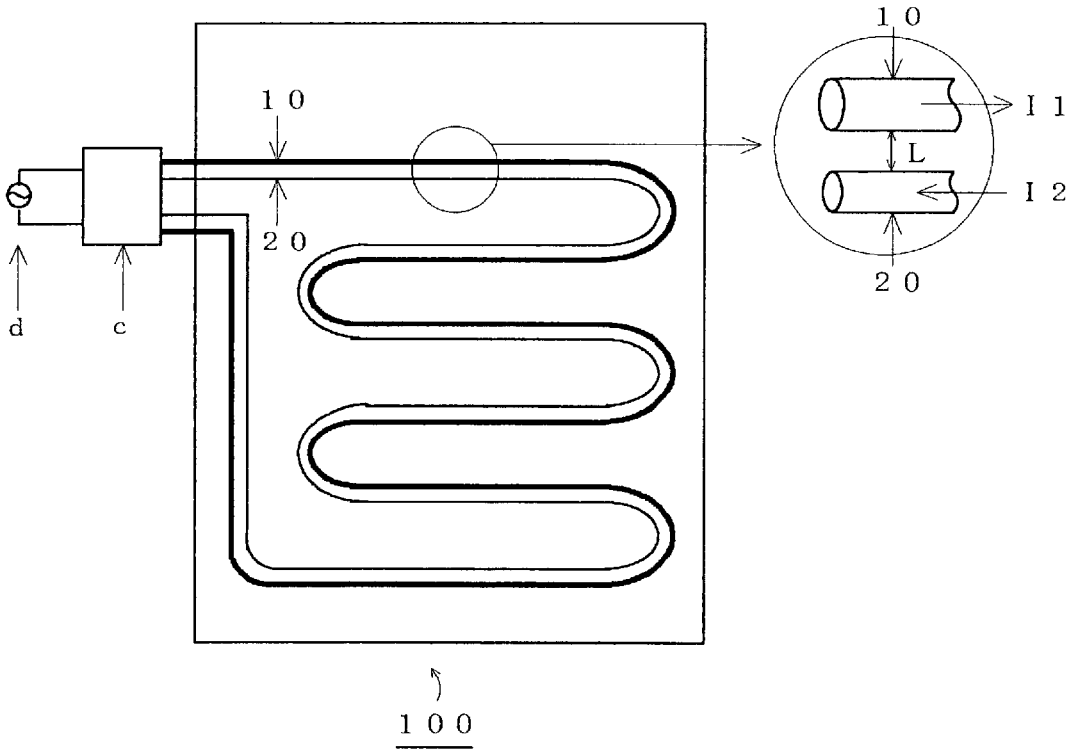
FIG. 3 is a schematic view of an example of the wiring pattern according to the present invention, accompanied at its right a partially enlarged view.

FIG. 3 is a schematic view showing an example of the heater cable in combination with a lead cable of the present invention, accompanied with a partially enlarged view at the right.

As shown in FIG. 3, the wiring pattern according to the present invention allows the heater cable 10 illustrated in FIG. 1 to extend along with the lead cable 20 illustrated in FIG. 2, hence constituting a wiring pattern 100 where opposite flows of current are introduced to the heater cable 10 and the lead cable 20 to minimize the generation of leak magnetic field. Also, the distance L between the heater cable 10 and the lead cable 20 in the wiring pattern 100 is set to a constant value not greater than 10 mm in order to effectively diminish the intensity of the leak magnetic field.

As a result, the wiring pattern 100 according to the present invention can favorably be used as a sheet-like heating appliance such as an electric blanket or an electric carpet. If the distance L between the heater cable 10 and the lead cable 20 is greater than 10 mm, the intensity of the leak magnetic field will hardly be diminished.

2. Measurement for the leak magnetic field on the heater cable.

Figure 4:
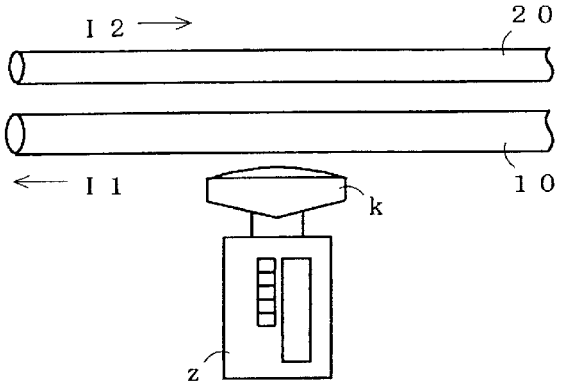
FIG. 4 is a schematic view showing a leak magnetic field detecting method of measuring a leak magnetic field on the heater cable.

The measurement for the leak magnetic field on the heater cable in the wiring pattern when it is energized will now be explained referring to FIG. 3 and FIG. 4. FIG. 4 is a schematic view showing a leak magnetic field measuring method of measuring the leak magnetic field on the heater cable.

In the leak magnetic field measuring method on the wiring pattern 100 according to the present invention, as shown in FIG. 3, while the heater cable 10 and the lead cable 20 are connected to a controller c and energized from an AC power source d to flow two opposite currents 11 and 12 respectively denoted by the arrow marks, the leak magnetic field on the heater cable 10 is measured with the detecting head k of a magnetic field detector z illustrated in FIG. 4.

Table 1, shown below, lists the resultant measurements of the leak magnetic field with different rates of the current introduced to the wiring pattern 100 of the first embodiment when the distance L between the heater cable 10 and the lead cable 20 is varied in three steps, 0 mm, 10 mm and 20 mm. The measurements are also plotted in FIG. 5.

Figure 5:
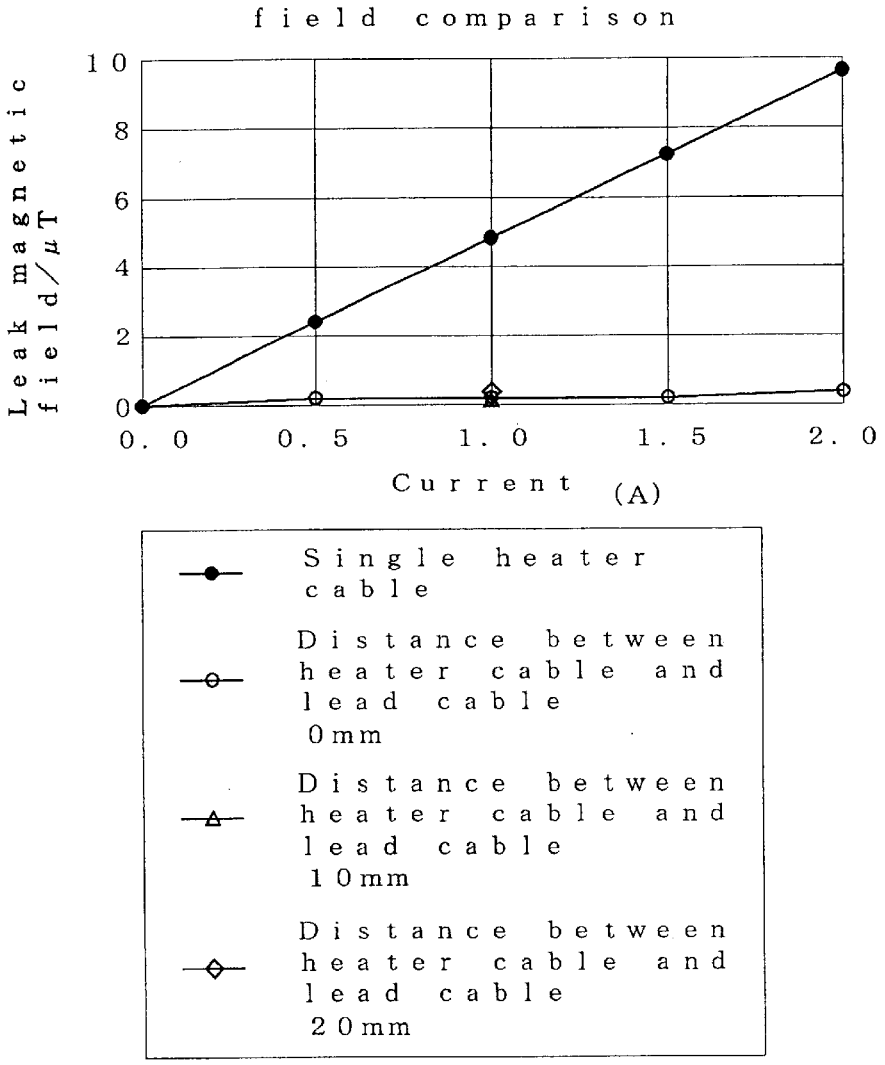
FIG. 5 is a graphic diagram showing resultant measurements of the leak magnetic field on the heater cable.

Table 2 illustrates a comparison where the heater cable 40 in the conventional pattern (as expressed a "single heater cable" in Table 2 and FIG. 5) is energized with different rates of the current and measured by the same method for detecting the leak magnetic field. The resultant measurements are shown in FIG. 5.

For the measurement, the frequency of the AC power source d was 60 Hz. A single detector complying with the MPR-II standard for VDU (visual display unit) testing (more specifically, "Combinova" MFM10, a product of Toyotechnica in Japan) was used as the magnetic field detector z.

TABLE 1

| Distance between Heater cable and Lead cable | | Leak magnetic field/μT 0 mm | 10 mm | 20 mm |
|---|---|---|---|---|
| Current (A) | 0.0 | 0.006 | 0.006 | 0.006 |
| | 0.5 | 0.202 | | |
| | 1.0 | 0.179 | 0.221 | 0.413 |
| | 1.5 | 0.166 | | |
| | 2.0 | 0.392 | | |

TABLE 2

| | | Leak magnetic Field/μT Single heater cable |
|---|---|---|
| Current (A) | 0.0 | 0.006 |
| | 0.5 | 2.549 |
| | 1.0 | 4.903 |
| | 1.5 | 7.500 |
| | 2.0 | 9.750 |

It is apparent from Table 1 and Table 2 and FIG. 5 that the intensity of the leak magnetic field on the heater cable 10 in the wiring pattern 100 of the first embodiment is varied depending on the rates of current supplied and its level is significantly smaller than that with the single heater cable of the conventional pattern. Also, it is proved that the leak magnetic field can substantially be diminished when the distance L between the heater cable and the lead cable, which are spaced from each other and not closely contacted to, is not greater than 10 mm.

The wiring pattern according to the present invention permits the heater cable to be wired along with the lead cable while the flows of current supplied to the heater cable and the lead cable are introduced in opposite directions. Consequently, the wiring pattern of the present invention can effectively diminish the leak magnetic field.

As set forth above, the wiring pattern cables according to the present invention when particularly used as a sheet-like heating appliance such as an electric blanket or an electric carpet will contribute to the diminishing of the leak magnetic field, which affects the human body, in an electronic apparatus or the like. Accordingly, the present invention is advantageous for use in various industrial fields.

3. Second Embodiment

The mode of embodiment of the wiring pattern of the present invention having copolymer polyester resin as its fusing layer will be described. Note that parts termed in the examples represents weight parts.

EXPERIMENT 1: Production of copolymer polyester resin (A) for fusing layer.

856 parts of dimethyl terephthalate of acid base and 897 parts of 1,4-butanediol of glycol base were supplied together with 0.37 part of tetra-n-butyl titanate used as a catalyst into a container which is equipped with a mixer, a thermometer, and a distillation condenser and subjected to esterification reaction at a temperature of 160 to 210° C. for 4 hours. Then, 216 parts of ϵ-caprolactone of glycol base and 1.08 parts of Irganox (a product of Ciba-Geigy) used as a stabilizer were added and mixed at 220° C. for 30 minutes to one hour to stimulate a further reaction. After the pressure was reduced to 5 mmHg throughout a duration of 40 minutes while the reaction temperature being increased to 255° C., a polycondensation process was finally carried out under a vacuum condition of less than 0.3 mmHg for one hour. As the result, a white product of copolymer polyester resin (A) for fusing layer was obtained. Its components analyzed by NMR (nuclear magnetic resonance) are shown in Table 3 below.

EXPERIMENT 2: Production of copolymer polyester resin (B) for fusing layer.

823 parts of dimethyl terephthalate, 961 parts of 1,4-butanediol, and 0.40 part of tetra-n-butyl titanate were supplied into a container similar to that of Example 1 and subjected to esterification reaction for a temperature of 160 to 210° C. for 4 hours. Then, 312 parts of dodecandione acid and 1.1 parts of Irganox were added and mixed at 160 to 210° C. for one hour and 20 minutes to stimulate the esterification reaction. After the pressure was reduced to 5 mmHg throughout a duration of 40 minutes while the reaction temperature being increased to 255° C., a polycondensation process was finally carried out under a vacuum condition of less than 0.3 mmHg for 50 minutes. As the result, a white product of copolymer polyester resin (B) for fusing layer was obtained. Its components analyzed by NMR are also shown in Table 3 below.

TABLE 3

Compositions analyzed by NMR

| | | Fusing layer material | Composition (mol %) | | |
|---|---|---|---|---|---|
| EXPERIMENT | 1 | copolymer polyester resin (A) | Terephthalic acid (43) | ϵ-caprolactone (13) | 1,4-butanediol (44) |
| | 2 | copolymer polyester resin (B) | Terephthalic acid (74) | dodecandione acid (26) | 1,4-butanediol (100) |

COMPARISON 1

The resin for fusing layer was nylon-12.

MEASUREMENT AND EVALUATION OF CHARACTERISTIC VALUES

Methods of measuring and evaluating various characteristic values of the copolymer polyester resins (A) and (B) produced by EXPERIMENT 1 and EXPERIMENT 2 and the resin (nylon-12) of COMPARISON 1 will be explained in more detail.

(a) Angle α between the baseline and a tangent to the heat absorption peak of a DSC curve determined by JIS K7121

Figure 7:
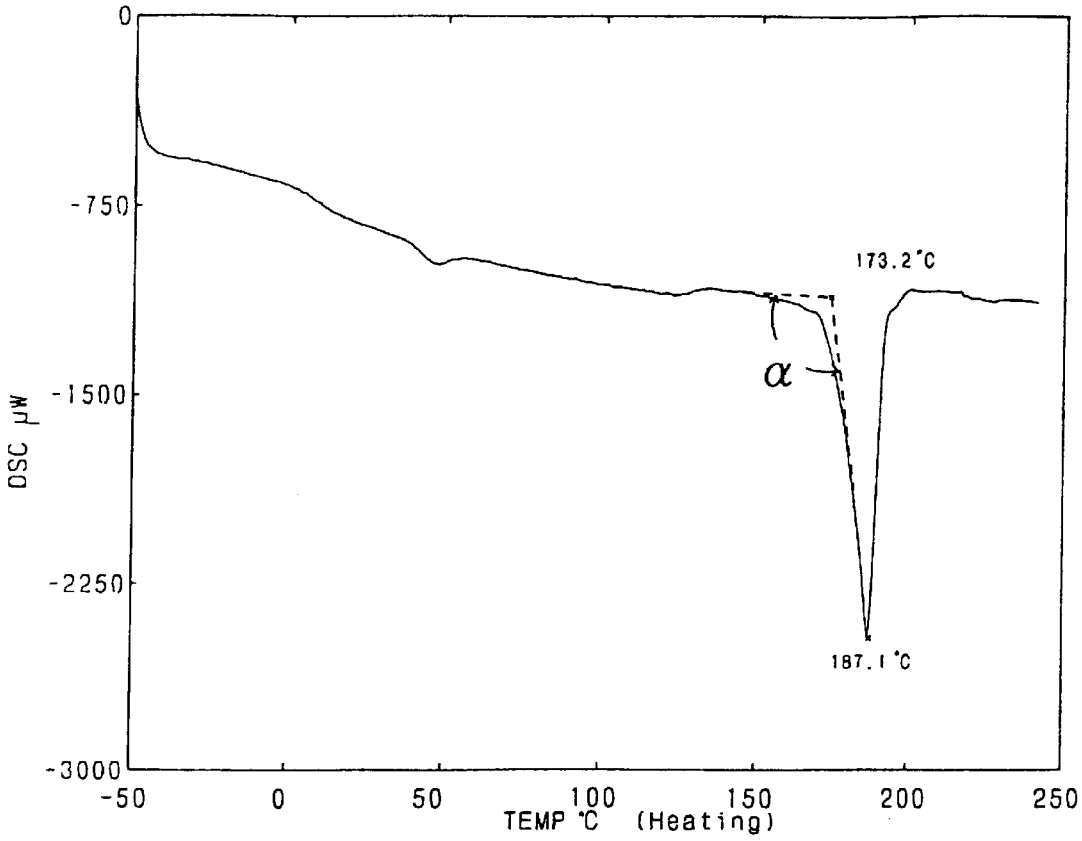
FIG. 7 is a chart showing a DCS curve of copolymer polyester resin (A)
Figure 8:
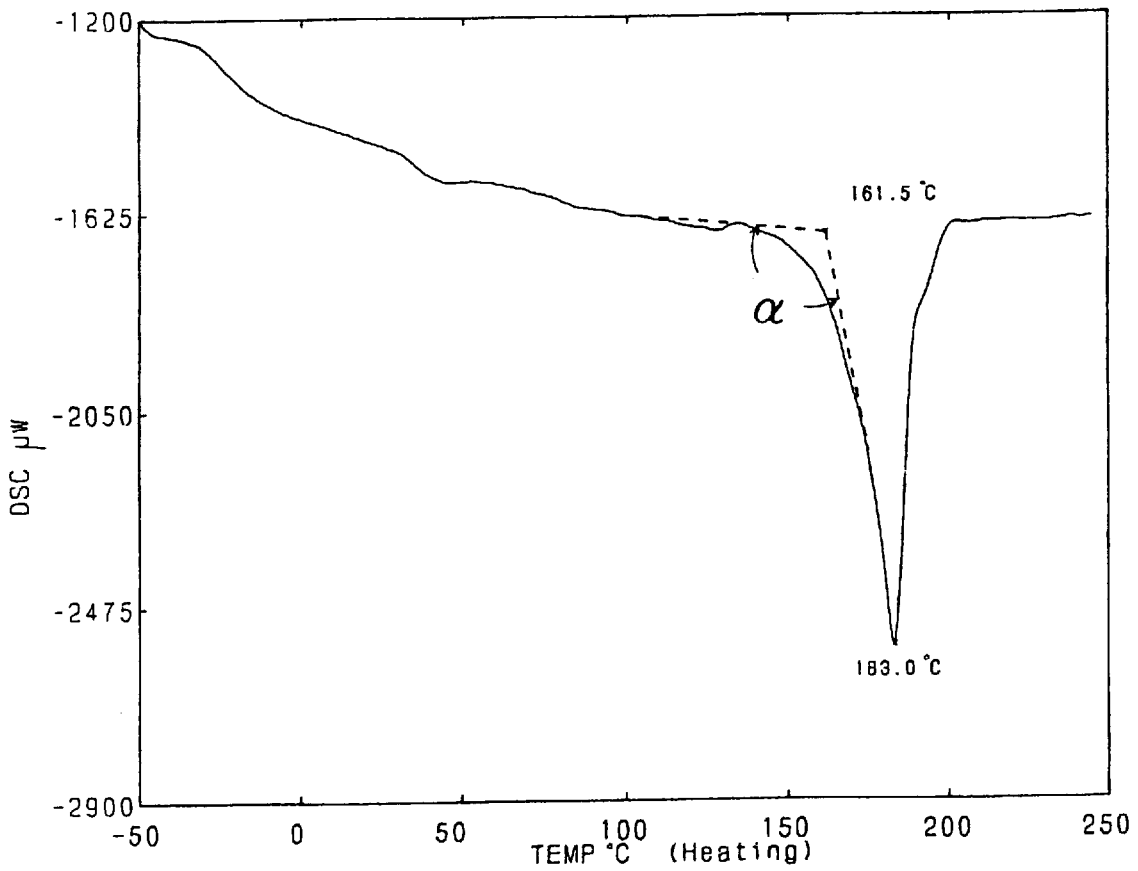
FIG. 8 is a chart showing a DCS curve of copolymer polyester resin (B)
Figure 9:
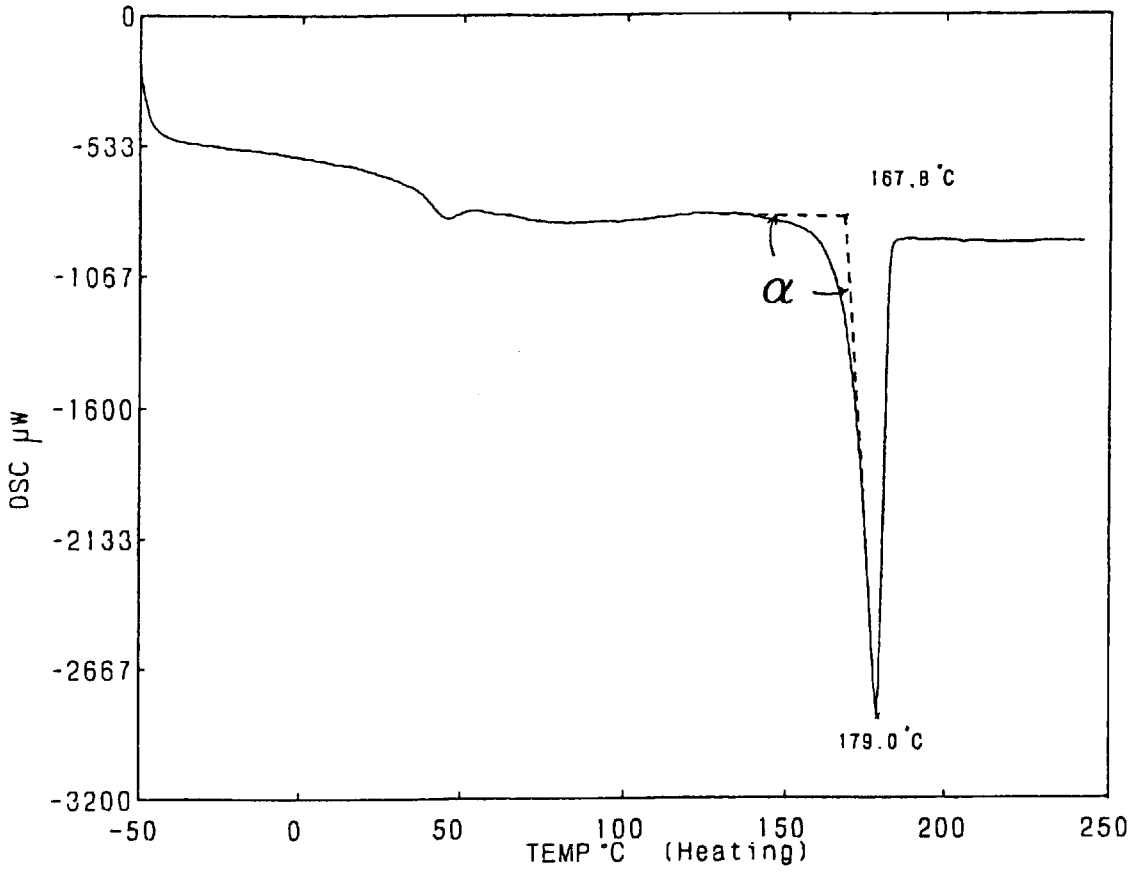
FIG. 9 is a chart showing a DCS chart of nylon-12.

The DSC curve is plotted from measurements of the copolymer polyester resins (A) and (B) and nylon-12 which were recorded by a JIS K7121 (Measurement for transition temperature of plastic materials) oriented manner using thermal analysis measuring devices (H-5200 and DSC-220C of Seiko Electronics). The measurement was carried out with a test piece of 3.5 mg precisely weighed under the conditions including 10° C./min of temperature rising speed, −50° C. to 250° C. of measuring temperature range, 1 time/second of data retrieval, the atmospheric level of pressure, and the presence of air. As the DSC curves of the measurements are illustrated in FIG. 7, FIG. 8, and FIG. 9, the temperature is read in 7.6 mm/10° C. along the x axis and the calorie in 6.0 mm/100 μw along the y axis.

Figure 13:
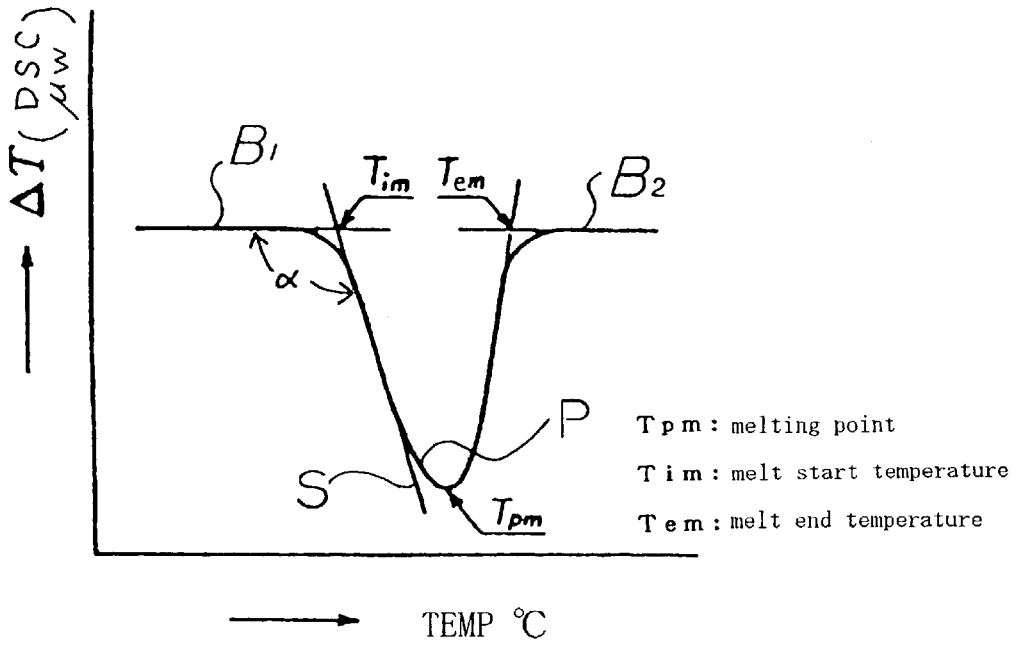
FIG. 13 is a diagram of a DCS curve model.

The calculation of the angle α is explained referring to the DSC curve of FIG. 13. As shown in FIG. 13, the DSC curve is based on the differential scanning calorie metering and plotted in a graph defined by the y axis representing a difference ΔT (DSC μw) between two thermal energy inputs per unit time which were applied to the test piece and a reference substance so that their temperatures are identical to each other and the x axis representing the temperature. The baselines B1 and B2 are portions of the DSC curve illustrating a temperature range where no transition and reaction are detected on the test piece. The heat absorption peak P is a portion of the DSC curve between the baseline B1 and B2. Denoted by S is a tangent to the left leg of the heat absorption peak P. The angle α is given between the tangent S and the baseline B1. Measurements of the angle α shown in FIG. 7, FIG. 8, and FIG. 9 are listed in Table 4.

TABLE 4

| | | Angle α between the baseline and a tangent to the heat absorption peak | |
|---|---|---|---|
| | | Fusing layer material | degree (°) of α |
| EXPERIMENT | 1 | Copolymer polyester resin (A) | 108 |
| | 2 | Copolymer polyester resin (B) | 110 |
| COMPARISON | 1 | Nylon-12 | 95 |

(b) Angle α' between the baseline and a tangent to the shift of a TMA curve measured in an expansion mode by thermal-mechanical measurement.

Figure 10:
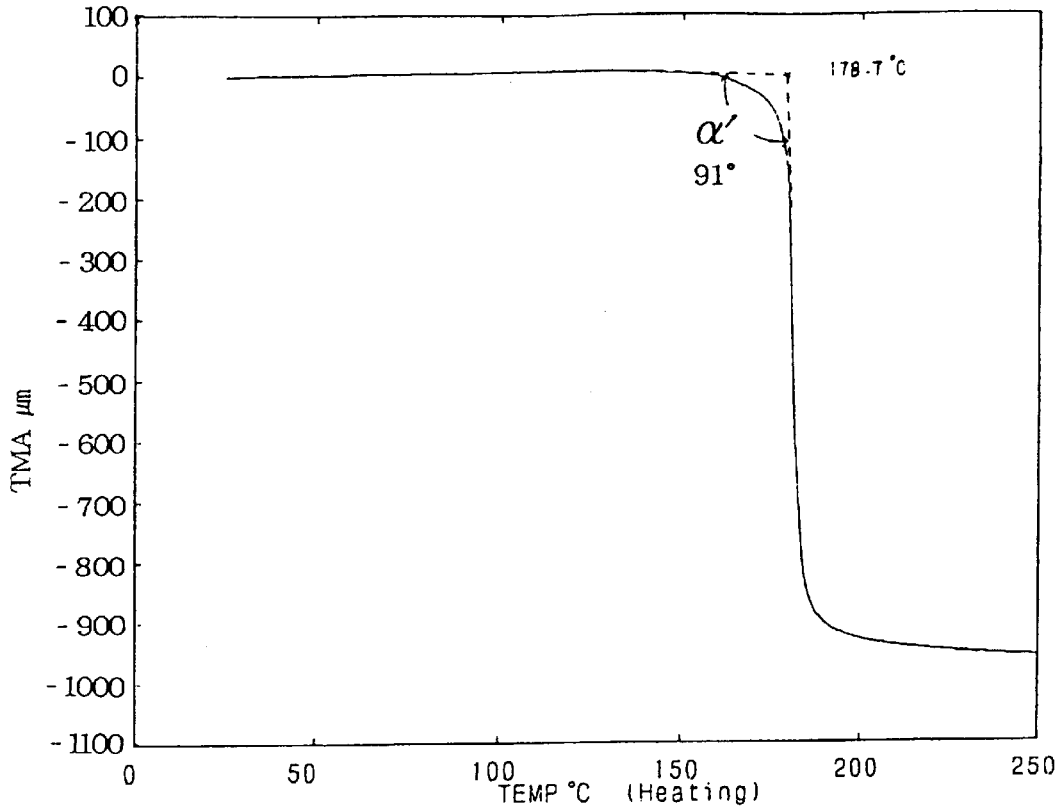
FIG. 10 is a chart showing a TMA curve of the copolymer polyester resin (A)
Figure 11:
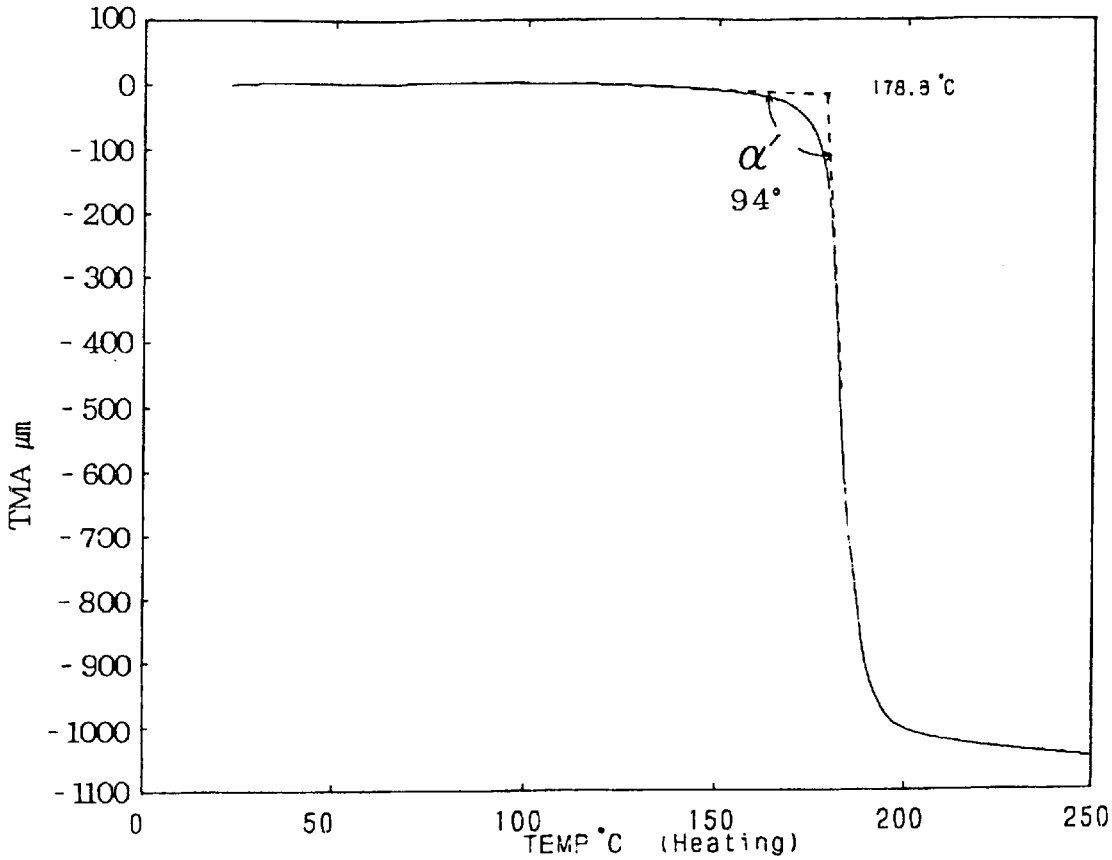
FIG. 11 is a chart showing a TMA curve of the copolymer polyester resin (B)
Figure 12:
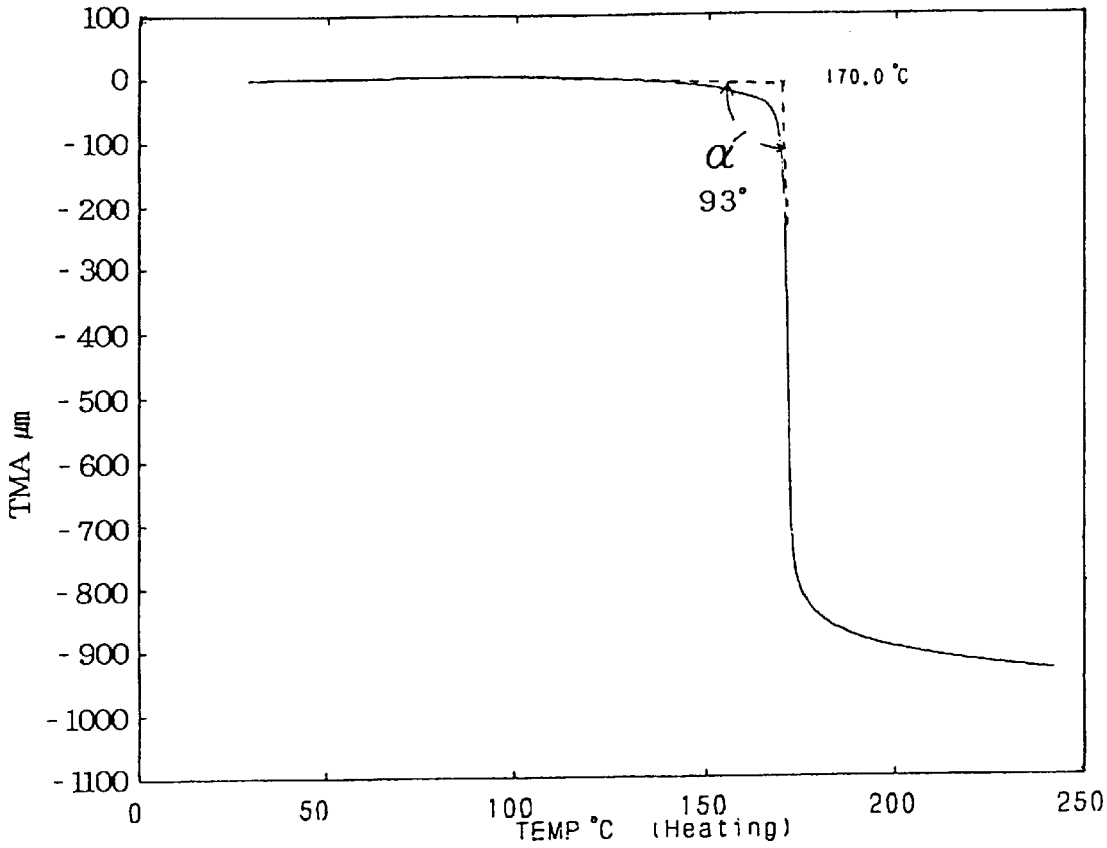
FIG. 12 is a chart showing a TMA chart of the nylon-12.

The TMA curve is plotted from measurements of the copolymer polyester resins (A) and (B) and nylon-12 which were recorded by a TMA expansion mode manner using thermal analyzing devices (H-5200 and TMA/SS-150C of Seiko Electronics). Each test piece used was sized to a 5×5 mm square with a thickness of 1 mm, held between two silica disks (10 mm in diameter and 1 mm in thickness), and measured under the conditions including 5° C./min of temperature rising speed, 0° C. to 250° C. of measuring temperature range, 1 time/second of sampling, the atmospheric level of pressure, and the presence of air. The resultant measurements are expressed in a TMA curve where the temperature is read in 6.3 mm/10° C. along the x axis and the shift in 15 mm/100 μm along the y axis. The TMA curves are shown in FIG. 10, FIG. 11, and FIG. 12.

Figure 14:
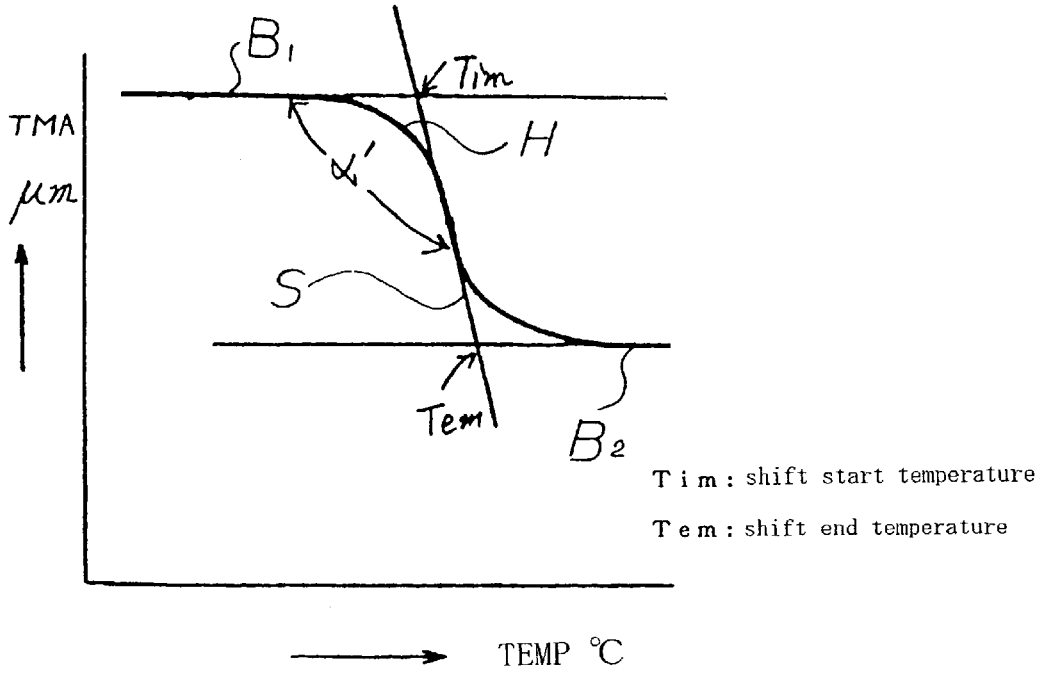
FIG. 14 is a diagram of a TMA curve model.
Figure 15:
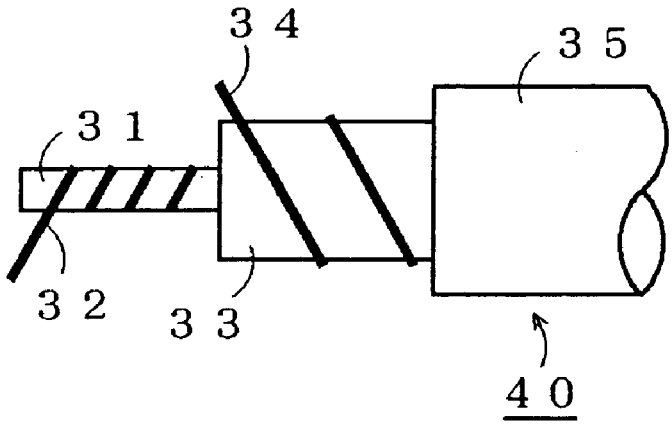
FIG. 15 is a schematic view showing a structure of a conventional heater cable.
Figure 16:
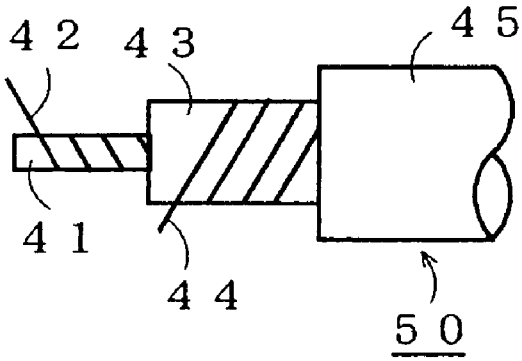
Prior Art Fig. 16
FIG. 16 is a schematic view showing a structure of a conventional signal wire.

The calculation of the angle α' is explained referring to a TMA curve model of FIG. 14. The model illustrate TMA μm along the y axis and the temperature along the x axis. The baseline B1 and B2 are portions of the TMA curve illustrating a range of temperature where no transition and reaction are detected on the test pieces. The shift curve H is a portion of the TMA curve between the baselines B1 and B2. Denoted by S is a tangent to the shift curve H. The angle α' is defined between the tangent S and the baseline B1. Measurements of the angle α' from FIG. 10, FIG. 11, and FIG. 12 are shown below in Table 5.

TABLE 5

| | | Angle α' between the baseline and a tangent to the shift curve | |
|---|---|---|---|
| | | Fusing layer material | degree (°) of α' |
| EXPERIMENT | 1 | Copolymer polyester Resin (A) | 91 |
| | 2 | Copolymer polyester Resin (B) | 94 |
| COMPARISON | 1 | Nylon-12 | 93 |

(c) Melting point of copolymer polyester resins (A) and (B) and nylon-12.

The measurement of the melting point was carried out by a JIS K7121 based manner (Measurement for transition temperature of plastic materials) where a temperature (Tpm) on the DSC curve was recorded as the melting point using thermal analysis measuring devices (H-5200 and DSC-220C of Seiko Electronics). Measurements of the melting points are shown below in Table 6.

TABLE 6

| | | Melting point | |
|---|---|---|---|
| | | Fusing layer material | Melting point (° C.) |
| EXPERIMENT | 1 | Copolymer polyester Resin (A) | 187.1 |
| | 2 | Copolymer polyester Resin (B) | 183.0 |
| COMPARISON | 1 | Nylon-12 | 179.0 |

(d) Measurement of reduction viscosity

The measurement of reduction viscosity (dl/g) was carried out in which 0.1 g of a test piece was sampled from each of the resins which had completely been dried out, dissolved in 25 ml of a mixture solvent containing phenol/tetrachloroethane (6/4 of weight ratio), and measured at 30° C. using a viscometer. Measurements of the reduction viscosity are shown below in Table 7.

TABLE 7

| | | Reduction viscosity | |
|---|---|---|---|
| | | Fusing layer material | Reduction viscosity (dl/g) |
| EXPERIMENT | 1 | Copolymer polyester Resin (A) | 0.89 |
| | 2 | Copolymer polyester Resin (B) | 0.92 |
| COMPARISON | 1 | Nylon-12 | *(1.80 ± 0.05) |

Note*: complied to DIN 53727

(e) Measurement of moisture absorption

The measurement of moisture absorption started with a test piece of 15 cm long, 4 cm wide, and 100 μm thickness being fabricated from each of the resins and completely dried out in a vacuum dryer. The test piece was then placed in an airtightly sealed lid-openable weighting bottle and weighed using a chemical balance. The measurement of weight was expressed by Ws. Then, the lid of the bottle was removed and the bottle was set in a normal-temperature, normal-moisture vessel where the temperature was 20±2° C. and the relative moisture was 65±2 %. After 72 hours or more, the lid was returned back on the bottle. The weighting bottle was taken out from the vessel and weighed again. The measurement of weight then was expressed by Wm. Note that the bottle itself weighs Wo. The moisture absorption (%) was calculated from the following formula 1. Results of the moisture absorption are shown below in Table 8.

$$\text{Moisture absorption (\%)} = (Wm - Ws)/(Ws - Wo) \times 100 \qquad \text{Formula 1}$$

TABLE 8

| | | Moisture absorption | |
|---|---|---|---|
| | | Fusing layer material | Moisture Absorption (%) |
| EXPERIMENT | 1 | Copolymer polyester Resin (A) | 0.78 |
| | 2 | Copolymer polyester Resin (B) | 0.71 |
| COMPARISON | 1 | Nylon-12 | 1.36 |

(f) Measurement of hardness

The measurement of hardness was carried out by a JIS K7215 (Durometer hardness test for plastic materials) based manner. Test pieces were uniformly shaped to a30-mm square with a thickness of 5 mm by heat pressing and measured using a hardness meter made by Instrument & Mfg. Co. Inc. Measurements of the hardness are shown below in Table 9.

TABLE 9

| | | Hardness | |
|---|---|---|---|
| | | Fusing layer material | Hardness (HDD) |
| EXPERIMENT | 1 | Copolymer polyester Resin (A) | 71 |
| | 2 | Copolymer polyester Resin (B) | 62 |
| COMPARISON | 1 | Nylon-12 | 76 |

REVIEW OF CHARACTERISTIC TEST RESULT

As apparent from the test results on the characteristics (a) to (f) shown in Table 4 to Table 9, the copolymer polyester resins (A) and (B) of EXPERIMENT 1 and EXPERIMENT 2 satisfy the requirements of the characteristics (a) to (f).

On contrary, nylon-12 of Comparison 1 provides a higher percentage of the moisture absorption and a higher level of the hardness.

FABRICATION OF HEATER CABLE

EXPERIMENT 3: Fabrication of a heater cable (A) having the fusing function.

The fabrication of a heater cable (A) having the fusing function is now explained referring to FIG. 1. Three 0.14-mm-diameter copper wires were wound in a spiral on the outer surface of a core 1, which was a polyester thread of 1500D and 120 T/m having a diameter of 0.45 mm, to form a heating conductor 2. A fusing layer 3 of 0.445 mm thick was provided over the heating conductor 2 by a tubing extruder (40 mm, L/D=25), not shown, extruding the copolymer polyester resin (A) into a tubular shape under the conditions; 180° C. (at the entrance), 190° C. (at a midway), and 190° C. (at the exit) of cylinder temperature, 200° C. of dice head temperature, 15 to 20% of drawdown, and 280 m/min of extrusion linear speed. Then, three 0.13 mm-diameter copper wires were wound in a spiral on the outer surface of the fusing layer 3 to form a short-circuit signal line 4. A protective coating 5 was provided over the short-circuit signal line 4 by extruding a dose of PVC so that the outer diameter was 2.35 mm, hence completing the heater cable 10 with the fusing function. The heater cable 10 was designed for a rating of 100 V–350 W.

EXPERIMENT 4: Fabrication of a heater cable (B) having the fusing function.

A heater cable (B) was fabricated by the same manner as of EXPERIMENT 3, except that the fusing layer 3 was made of the copolymer polyester resin (B).

COMPARISON 2

A heater cable (C) was fabricated by the same manner as of EXAMPLE 3, except that the fusing layer 3 was made of nylon-12.

CHARACTERISTIC TESTS FOR HEATER CABLE

1. Fusing Test

Figure 6:
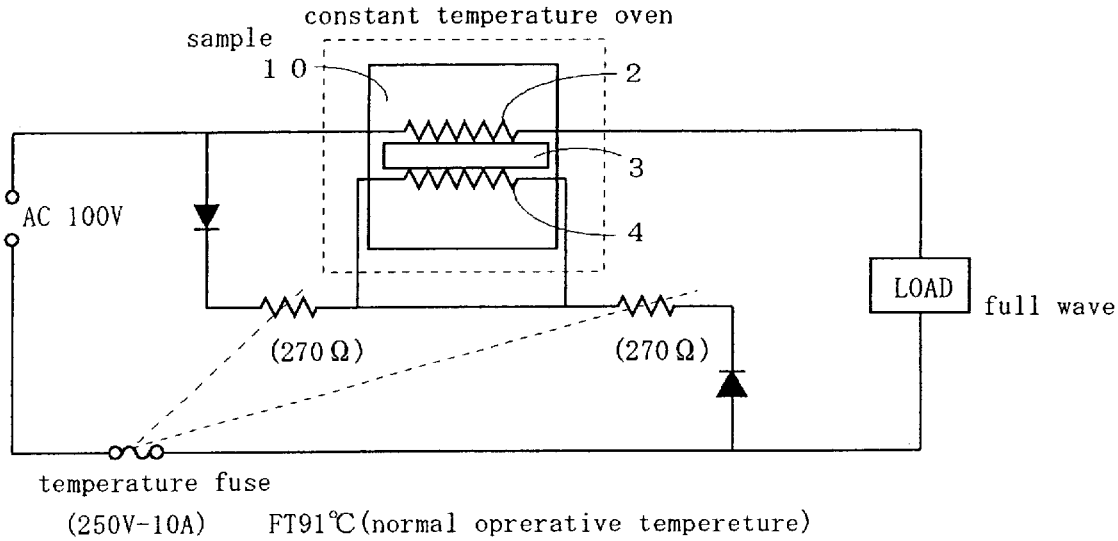
FIG. 6 is a schematic view showing a fusing detecting circuit of the heater cable.

The heater cables (A), (B), and (C) of EXAMPLE 3 and EXAMPLE 4 and COMPARISON 2 were cut to substantially 2 m lengths and each length was separated into five segments. After treated at both ends, test pieces of 25 cm long were prepared. The test pieces were loaded into a normal-temperature vessel, impressed between their heating conductors and short-circuit lines by a voltage of 100 V, and heated up at a rate of 1° C./min. The temperature when the heating conductor and the short-circuit signal line were short-circuited was detected and recorded as a fusing temperature. A circuit used for the fusing test is illustrated in FIG. 6. Resultant measurements of the test are listed below in Table 10.

TABLE 10

| | | Fusing temperature of heater cable (n = 5) | |
|---|---|---|---|
| | | Heater cables | Fusing temperature (° C.) |
| EXPERIMENT | 3 | Heater cable (A) | 162 163 163 164 163 (X = 163.0° C.) |
| | 4 | Heater cable (B) | 164 165 165 165 165 (X = 164.8° C.) |
| COMPARISON 2 | | Heater cable (C) | 164 162 162 162 162 (X = 162.4° C.) |

2. Anti-heat deterioration test (Self-radial winding estimation test)

For examining the operating life of the heater cables (A), (B), and (C) of EXAMPLE 3 and EXAMPLE 4 and COMPARISON 2 in view of thermal deterioration, an anti-heat deterioration test was carried out. Three test pieces having a length of 30 cm were cut out from each of the heater cables and placed in a normal-temperature vessel set to 140° C. for thermal deterioration. For evaluation of the anti-heat deterioration, the test pieces were taken out from the normal-temperature vessel at equal intervals of a specific time, peeled off their PVC protective coatings, and closely wound ten times on round bars of which the diameter was two times greater than that of the heater cables while being tensioned by a load (350 g) to find whether or not any sign of crack occurred in their fusing layers. Upon finding a crack, the anti-heat deterioration test for (the fusing layer material of) the heater cable was terminated. A no-good result was given when any of a set of the three test pieces of each heater cable generated a sign of crack. Results of the test are shown below in Table 11.

TABLE 11

| | | Anti-heat deterioration characteristics of heater cable (n = 3) | | | | | | | | |
|---|---|---|---|---|---|---|---|---|---|---|
| | | EXAMPLE | | | | | | COMPARISON | | |
| | | 3 | | | 4 | | | 2 | | |
| Heater cable | | Heater cable (A) | | | Heater cable (B) | | | Heater cable (C) | | |
| Resin for Fusing layer | | Copolymer polyester resin (A) | | | Copolymer polyester resin (B) | | | Nylon-12 | | |
| Heat up Time | 7 days (168 hrs) | ○ | ○ | ○ | ○ | ○ | ○ | ○ | ○ | ○ |
| | 10 days (240 hrs) | ○ | ○ | ○ | ○ | ○ | ○ | ○ | ○ | ○ |
| | 11 days (264 hrs) | ○ | ○ | ○ | ○ | ○ | ○ | ○ | ○ | ○ |
| | 12 days (288 hrs) | ○ | ○ | ○ | ○ | ○ | ○ | ○ | ○ | ○ |
| | 13 days (312 hrs) | ○ | ○ | ○ | ○ | ○ | ○ | ○ | ○ | × |
| | 14 days (336 hrs) | ○ | ○ | ○ | ○ | ○ | ○ | ○ | × | × |
| | 15 days (360 hrs) | ○ | ○ | ○ | ○ | ○ | ○ | × | × | × |
| | 17 days (408 hrs) | ○ | ○ | ○ | ○ | ○ | ○ | × | × | × |
| | 19 days (456 hrs) | ○ | ○ | ○ | ○ | ○ | ○ | × | × | × |
| | 21 days (504 hrs) | ○ | ○ | ○ | ○ | ○ | ○ | | — | |

○ : no crack. ×: crack found.

As apparent from Table 10, the fusing temperatures of the heater cables (A) and (B) according to the present invention are substantially equal to that of nylon-12. Also, it is clear from the result of the anti-heat deterioration test shown in Table 11, (the fusing layer materials of) the heater cables (A) and (B) exhibit no sign of crack after 504 hours of the heating time at 140° C. which exceeds 336 hours. On contrary, the anti-heat deterioration of the heater cable (C) of COMPARISON 2 is as low as 288 hours. Accordingly, the heater cables of the present invention have the operating life about 1.7 times greater than that of the conventional heater cable.

The characteristics (a) to (f) of the copolymer polyester resin for fusing layer according to the present invention are significantly identical to those desired for the fusing layer of a heater cable. The heater cable of the present invention fabricated using the same resin is hence highly sensitive and rigorous in the fusing action (the response to a temperature) and will be most ideal as featuring the fusing function. In particular, the moisture absorption is substantially ½ smaller than of nylon-12. This allows the fusing layer to be diminished in the moisture absorption and declination in the precision of the fusing function due to the moisture absorption will be minimized.

In the heater cable according to the present invention, the fusing layer resin which plays the most significant role of the heater cable fusing function has the anti-heat deterioration 1.7 times higher than that made of nylon-12 and is highly improved in the operating life. Consequently, a higher quality of the heater cable with the fusing function can be provided which is reliable in the performance.

Also, the copolymer polyester resin of the present invention is remarkably flexible thus giving a higher resiliency of the heater cable. This permits the heater cable to be wired and located with much ease in a base material during the production of a sheet-like heating body, thus notably increasing the productivity. Moreover, the melt viscosity (900 poises at 220° C.) of the copolymer polyester resin of the present invention is as small as substantially ⅕ that of nylon-12 (4500 poises at 220° C.). This allows a common tubing extruder to be used for forming the fusing layer and at the same time, significantly increases the extrusion speed. Accordingly, since the production cost of the heater cable is declined, the present invention contributes to the development of industrial applications.

What is claimed is:

1. A cable comprising:

a heater cable; and a lead cable, the heater cable including:

a core thread;

a heating element wire wound in a spiral on the outer surface of the core thread;

a fusing layer coated over the heating element wire;

a signal wire wound in a spiral on the outer surface of the fusing layer; and a protective coating provided over the signal wire;

the lead cable including:

an insulating coating; and a conductive wire covered at an outer surface thereof with the insulating coating; and the heater cable and the lead cable running adjacent one another and being spaced from each other by a distance of 0 to 10 mm and being capable of being supplied with opposite flows of current.

2. The cable according to claim 1, wherein the fusing layer is made of copolymer polyester resin having fusing function characteristics of:

an angle $\alpha$ between the baseline and a tangent to the heat absorption peak of a DSC curve defined by a JIS K7121 method being 90° to 120°;

an angle $\alpha'$ between the baseline and a tangent to the shift portion of a TMA curve determined in an expansion mode by a thermal-mechanical measuring method being 90° to 100°;

a melting point being 160° C. to 210° C.;

a reduction viscosity being not lower than 0.5 dl/g;

a moisture absorption being not higher than 1.0% at a temperature of 20° C. and a relative moisture rate of 65%; and a hardness measured by a JIS K7215 method being HDD 40 to 74.

3. The cable according to claim 1, wherein an anti-heat deterioration of the fusing layer stands for 500 hours at a temperature of 140° C.

4. The cable according to claim 1, wherein the fusing layer is made of copolymer polyester resin having fusing function characteristics of:

an angle $\alpha$ between the baseline and a tangent to the heat absorption peak of a DSC curve defined by a JIS K7121 method being 90° to 120°;

a melting point being 160° C. to 210° C.;

a reduction viscosity being not lower than 0.5 dl/g;

a moisture absorption being not higher than 1.0 % at a temperature of 20° C. and a relative moisture rate of 65%; and a hardness measured by a JIS K7215 method being HDD 40 to 74.

5. The cable according to claim 1, wherein the fusing layer is made of copolymer polyester resin having fusing function characteristics of:

an angle $\alpha'$ between the baseline and a tangent to the shift portion of a TMA curve determined in an expansion mode by a thermal-mechanical measuring method being 90° to 100°;

a melting point being 160° C. to 210° C.;

a reduction viscosity being not lower than 0.5 dl/g;

a moisture absorption being not higher than 1.0% at a temperature of 20° C. and a relative moisture rate of 65%; and a hardness measured by a JIS K7215 method being HDD 40 to 74.

* * * * *